US008308004B2

(12) United States Patent
Keung

(10) Patent No.: US 8,308,004 B2
(45) Date of Patent: Nov. 13, 2012

(54) DISPENSING PACKAGE HAVING NON-REMOVABLE AND NON-ROTATABLE DISPENSING CLOSURE

(75) Inventor: Wing-Kwong Keung, Perrysburg, OH (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 1027 days.

(21) Appl. No.: 11/285,245

(22) Filed: Nov. 22, 2005

(65) Prior Publication Data

US 2007/0114201 A1 May 24, 2007

(51) Int. Cl.

| | |
|---|---|
| ***B65D 39/00*** | (2006.01) |
| ***B65D 41/00*** | (2006.01) |
| ***B65D 43/00*** | (2006.01) |
| ***B65D 47/00*** | (2006.01) |
| ***B65D 51/00*** | (2006.01) |
| ***B65D 49/02*** | (2006.01) |
| ***B65D 17/32*** | (2006.01) |
| ***B65D 41/16*** | (2006.01) |
| ***B65D 41/18*** | (2006.01) |

(52) U.S. Cl. ..... 215/263; 215/28; 215/237; 215/317; 215/321; 220/268; 220/780

(58) Field of Classification Search ..... 215/237, 215/321, 317, 28, 263, 258; 220/780, 268
See application file for complete search history.

(56) References Cited

U.S. PATENT DOCUMENTS

| | | | | |
|---|---|---|---|---|
| 2,522,952 | A * | 9/1950 | Krohn | 312/31.1 |
| 3,025,989 | A * | 3/1962 | Williams | 215/252 |
| 3,255,928 | A | 6/1966 | Foster | |
| 3,592,349 | A * | 7/1971 | Baugh | 215/307 |
| 3,846,849 | A * | 11/1974 | Dooley et al. | 4/450 |
| 3,847,183 | A * | 11/1974 | Meyer | 138/96 R |
| 4,117,946 | A * | 10/1978 | Kessler | 215/321 |

(Continued)

FOREIGN PATENT DOCUMENTS

GB 2017049 A 9/1979

OTHER PUBLICATIONS

"Circumferential." Merriam-Webster Online Dictionary. 2010. Merriam-Webster Online. Jun. 16, 2010 <http://www.merriam-webster.com/dictionary/circumferential>.*

(Continued)

*Primary Examiner* — Anthony Stashick
*Assistant Examiner* — Andrew T Kirsch
(74) *Attorney, Agent, or Firm* — Reising Ethington PC

(57) ABSTRACT

A dispensing package includes a container having a neck finish with an axis, a non-circular cross section in a plane perpendicular to the axis, and at least one circumferentially extending external engagement element on the neck finish. A closure has a wall received over the container neck finish. The wall has a non-circular cross section corresponding to the non-circular cross section of the neck finish and at least one internal circumferentially extending engagement element in engagement with the external engagement element on the neck finish. The internal and/or external circumferentially extending engagement element has a shallow lead-in angle to enable press-fit of the closure onto the container neck finish and a steep back angle to retard removal of the closure from the neck finish. Rotation of the closure on the neck finish is prevented by the non-circular cross sections of the neck finish and the closure wall.

32 Claims, 4 Drawing Sheets

U.S. PATENT DOCUMENTS

| | | | | |
|---|---|---|---|---|
| 4,170,315 | A | 10/1979 | Dubach et al. | |
| 4,445,622 | A | 5/1984 | Sideri | |
| 4,629,081 | A | 12/1986 | McLaren | |
| 4,718,567 | A | 1/1988 | LaVange | |
| 4,759,455 | A | 7/1988 | Wilson | |
| 4,776,475 | A | 10/1988 | LaVange | |
| 4,940,167 | A * | 7/1990 | Fillmore et al. | 222/153.09 |
| 5,046,630 | A | 9/1991 | Schneider et al. | |
| 5,088,612 | A | 2/1992 | Storar et al. | |
| 5,143,235 | A | 9/1992 | Repp | |
| 5,392,938 | A | 2/1995 | Dubach | |
| 5,730,309 | A | 3/1998 | Jiradejnunt et al. | |
| 5,758,888 | A * | 6/1998 | Burgan et al. | 280/47.34 |
| 5,860,543 | A * | 1/1999 | Decelles | 215/209 |
| 5,902,060 | A * | 5/1999 | Rodriguez | 401/1 |
| 6,041,953 | A * | 3/2000 | Goodall | 215/354 |
| 6,364,101 | B1 | 4/2002 | Schultz | |
| 2005/0023285 | A1 | 2/2005 | Keung | |
| 2005/0023304 | A1 * | 2/2005 | Vogel et al. | 222/480 |
| 2005/0061765 | A1 | 3/2005 | Skillin et al. | |

OTHER PUBLICATIONS

PCT International Preliminary Report on Patentability, PCT/US2006/044694, International Filing Date—Nov. 17, 2006, 6 pages.

* cited by examiner

DISPENSING PACKAGE HAVING NON-REMOVABLE AND NON-ROTATABLE DISPENSING CLOSURE

The present disclosure is directed to a dispensing package having a non-removable and non-rotatable dispensing closure, and to a closure and a container for such a package.

BACKGROUND AND SUMMARY OF THE DISCLOSURE

A general object of the present disclosure is to provide a dispensing package that includes a dispensing closure that is non-removably and non-rotatably mounted on a container, and to provide a closure and a container for such a package. The term "non-removable" means that the closure is intended not to be removed from the container during normal use and cannot be readily removed from the container without the use of extraordinary force or tools.

The present disclosure embodies a number of aspects that can be implemented separately from or in combination with each other.

A dispensing package in accordance with one aspect of the present disclosure includes a container having a neck finish with an axis, a non-circular cross section in a plane perpendicular to the axis, and at least one circumferentially extending external engagement element. A closure has a wall received over the container neck finish. The wall has a non-circular cross section corresponding to the non-circular cross section of the neck finish and at least one internal circumferentially extending engagement element in engagement with the external engagement element on the neck finish. The internal circumferentially extending engagement element and/or the external circumferentially extending engagement element has a shallow lead-in angle to enable press-fit of the closure onto the container neck finish and a steep back angle to retard removal of the closure from the neck finish. Rotation of the closure on the neck finish is prevented by the non-circular cross sections of the neck finish and the closure wall.

The closure preferably includes a non-circular plug seal wall received within the container neck finish, and at least one pair of engagement elements on the wall and the neck finish are disposed radially outwardly from the plug-seal wall. The plug seal wall preferably not only functions to seal the closure against the container neck finish, but also to prevent inward compression of the container neck finish in the event that it is attempted to remove the closure from the container neck finish. The at least one engagement element having the shallow lead-in angle and the steep back angle preferably is disposed on the container neck finish, and preferably comprises a plurality of axially spaced external engagement elements on the container neck finish. The at least one internal engagement element on the closure wall preferably comprises a corresponding plurality of axially spaced rounded engagement elements. The engagement elements preferably are circumferentially continuous. In the preferred embodiment of the disclosure, the shallow lead-in angle is about 40° to the axis of the container neck finish and the steep back angle is about 75° to such axis. The closure preferably is a one-piece integrally molded closure having a lid hinged to a base, and a child-resistant latch between the hinge and the base.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

FIGS. 1-4 illustrate a dispensing package 20 in accordance with an exemplary embodiment of the disclosure as including a closure 22 applied to the neck finish 24 of a container 26. In accordance with the present disclosure, closure 22 is non-removably and non-rotatably mounted on container neck finish 24. As noted above, the term "non-removably" means that the closure is intended not to be removed from the container during normal use and is not removable from the neck finish without the use of extraordinary force or the use of a tool of some sort such as to pry the closure off of the container.

Figure 5:
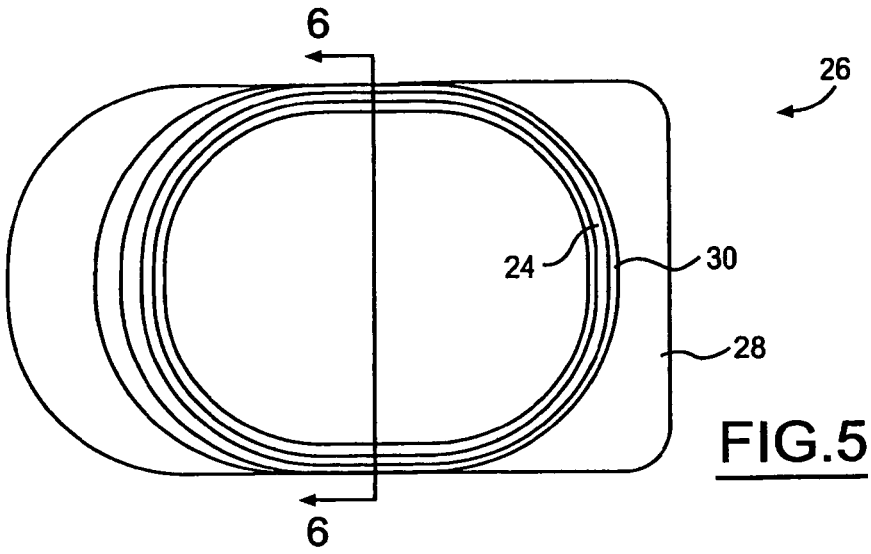
FIG. 5 is a top plan view of the container in the package of FIG. 1.
Figure 6:
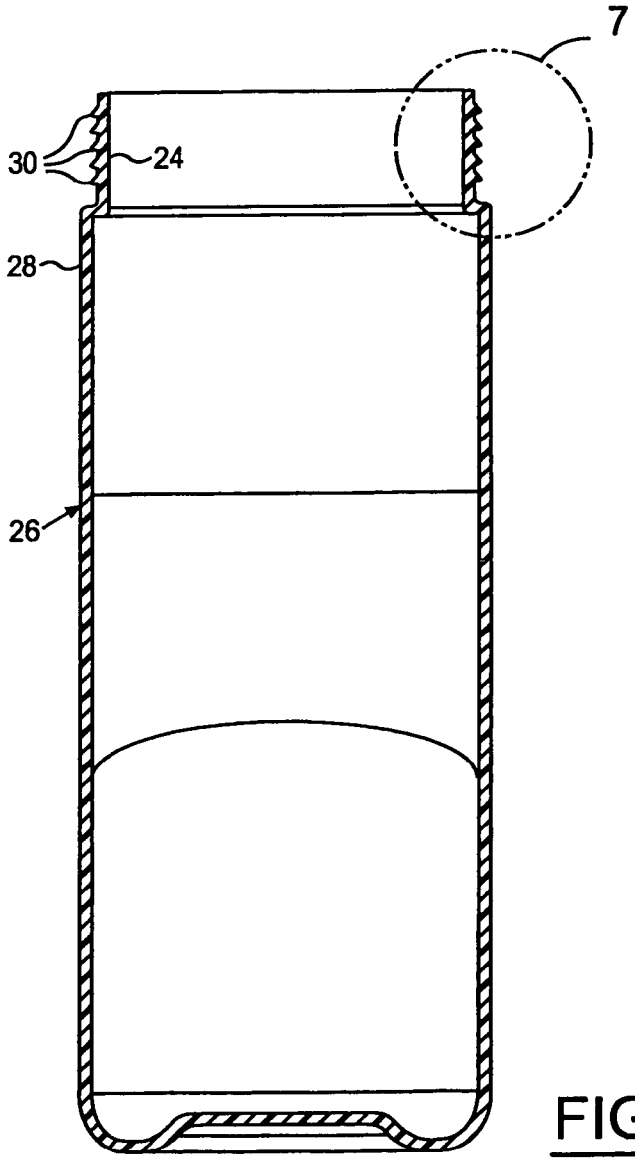
FIG. 6 is a sectional view taken substantially along the line 6-6 in FIG. 5.
Figure 7:
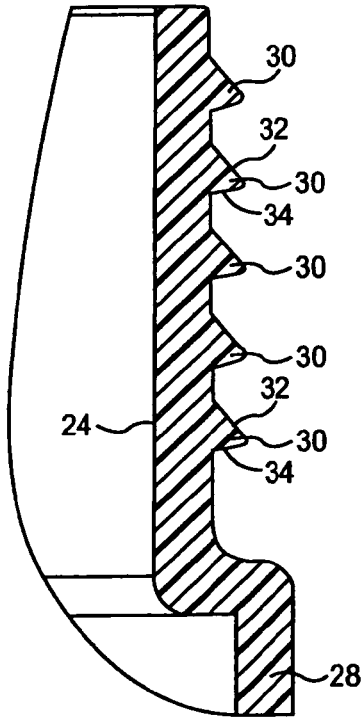
FIG. 7 is a fragmentary sectional view on an enlarged scale of the portion of FIG. 6 within the area 7.
Figure 8:
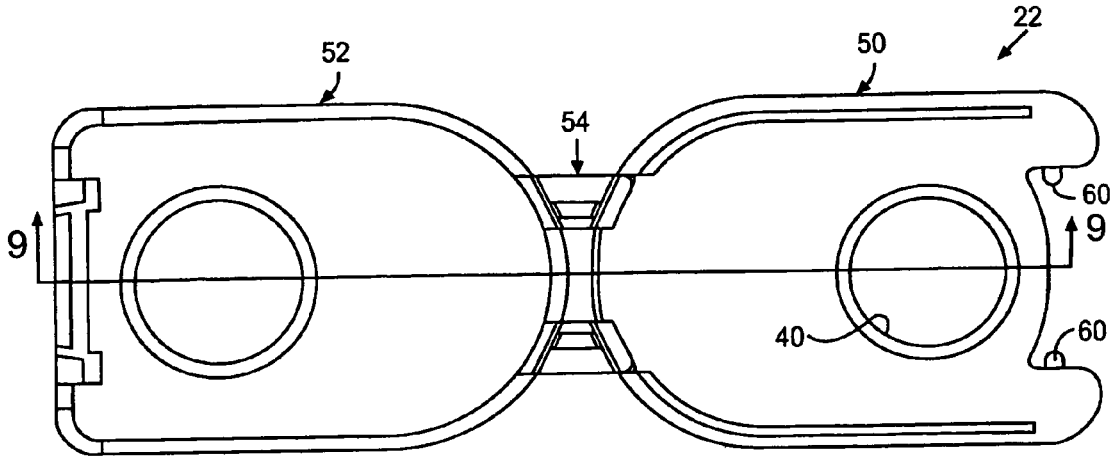
FIG. 8 is a top plan view of the closure in the package of FIG. 1 as molded.
Figure 9:
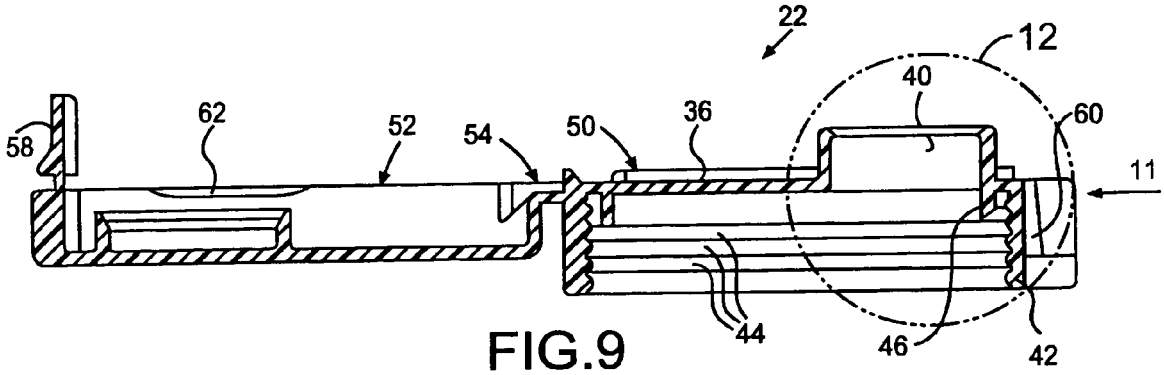
FIG. 9 is a sectional view taken substantially along the line 9-9 in FIG. 8.

Container 26 is illustrated in greater detail in FIGS. 5-7, and includes a body 28 from which neck finish 24 integrally extends. Container body 28 and neck finish 24 preferably are of one-piece integrally molded plastic construction, although neck finish 24 could be molded separately from body 28 and attached to body 28 in a post-molding operation. As another alternative, neck finish 24 could be insert molded to body 28, or vice versa. Neck finish 24 has a central axis, and has a non-circular cross section in a plane perpendicular to such axis, as best seen in FIG. 5. Container body 28 can be of any suitable geometry, with the geometry shown in the drawings being by way of example only. A plurality of axially spaced circumferentially extending engagement elements 30 are provided on the external surface of neck finish 24, preferably by being molded integrally with the neck finish. Engagement elements 30 preferably are in the form of circumferentially extending ratchet teeth that have shallow lead-in angles at the surfaces 32 facing in the direction of the open mouth of the neck finish and steep back angles at the surfaces 34 facing away from the open end of the neck finish. Engagement elements 30 preferably are circumferentially continuous entirely around the outer surface of neck finish 24, although gaps or spaces could be provided in the engagement elements without departing from the scope of the present disclosure in its broadest aspects. In the exemplary embodiment of the disclosure illustrated in the drawings, the shallow lead-in angles of surfaces 32 preferably are about 40° to the axis of the neck finish, while the steep back angles of surfaces 34 preferably are about 75° to the axis of the neck finish. Container body 28 and neck finish 24 can be formed in any suitable molding operation, preferably an injection blow molding operation or an injection or compression reheat blow molding operation, which are suitable for forming engagement elements 30 of sharp ratchet-tooth definition as described above. Container 26 can be of any suitable material, such as polypropylene for example.

Figure 1:
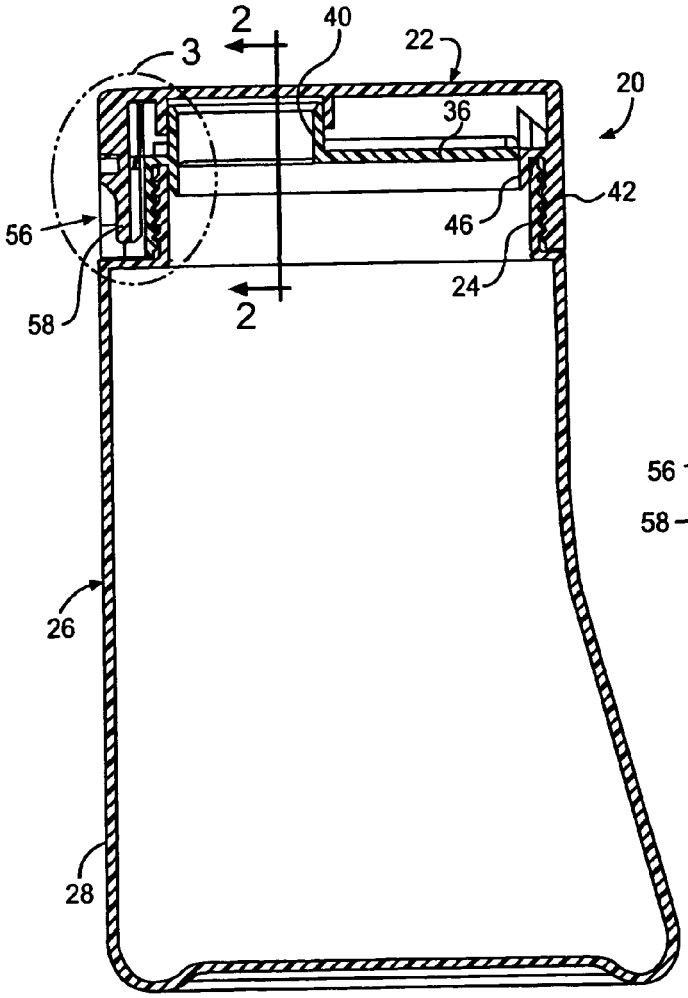
FIG. 1 is a sectional view bisecting a package in accordance with an exemplary embodiment of the disclosure.
Figure 3:
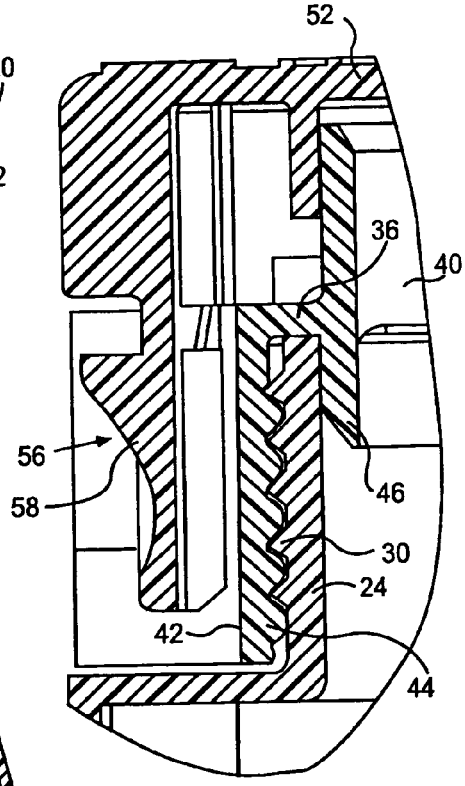
FIG. 3 is a fragmentary sectional view on an enlarged scale of the portion of FIG. 1 within the area 3.
Figure 2:
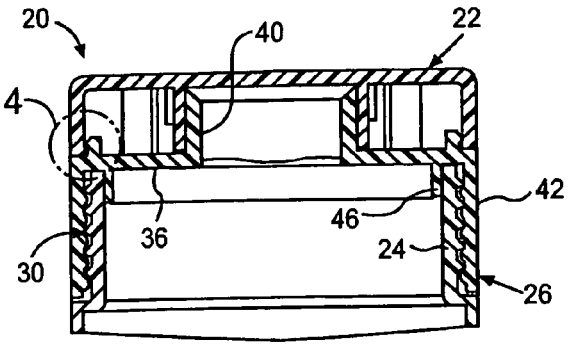
FIG. 2 is a fragmentary sectional view taken substantially along the line 2-2 in FIG. 1.
Figure 4:
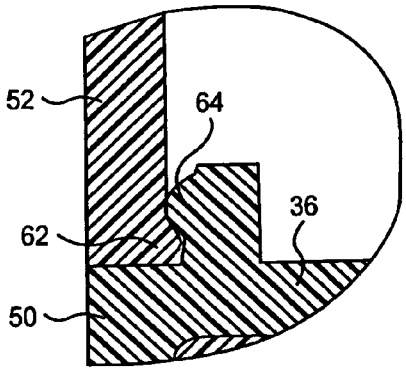
FIG. 4 is a fragmentary sectional view on an enlarged scale of the portion of FIG. 2 within the area 4.
Figure 10:
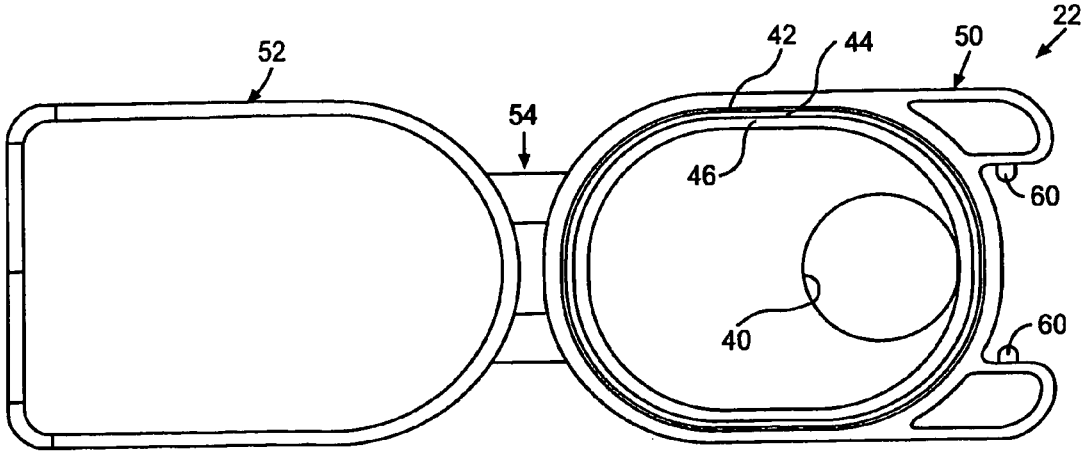
FIG. 10 is a bottom plan view of the closure in FIGS. 8 and 9.
Figure 11:
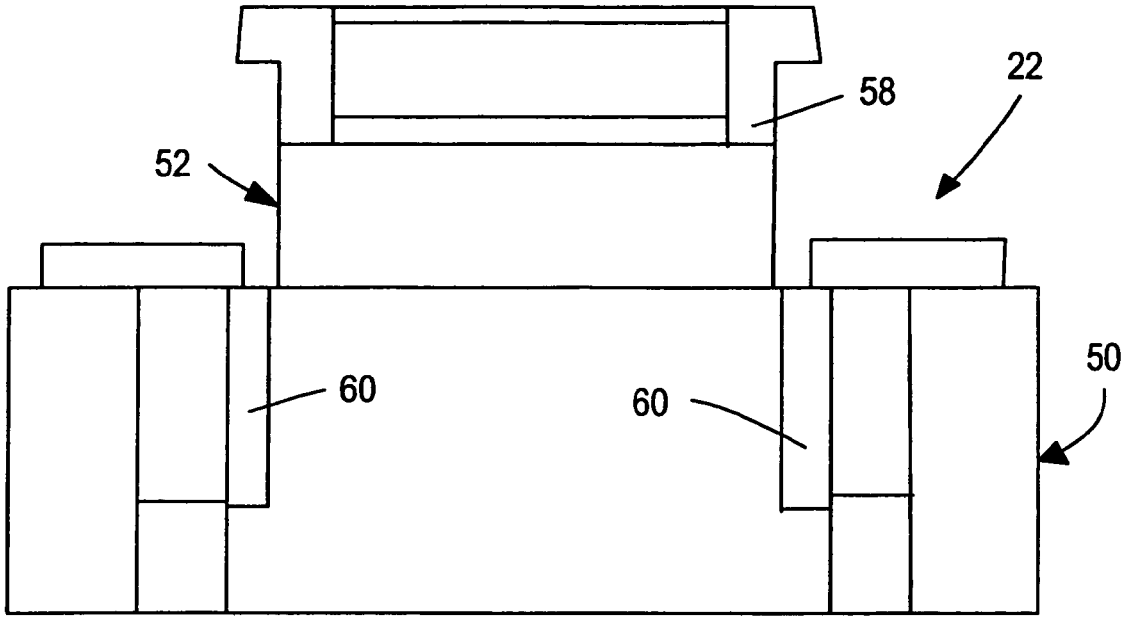
FIG. 11 is an elevational view taken from the direction 11 in FIG. 9.
Figure 12:
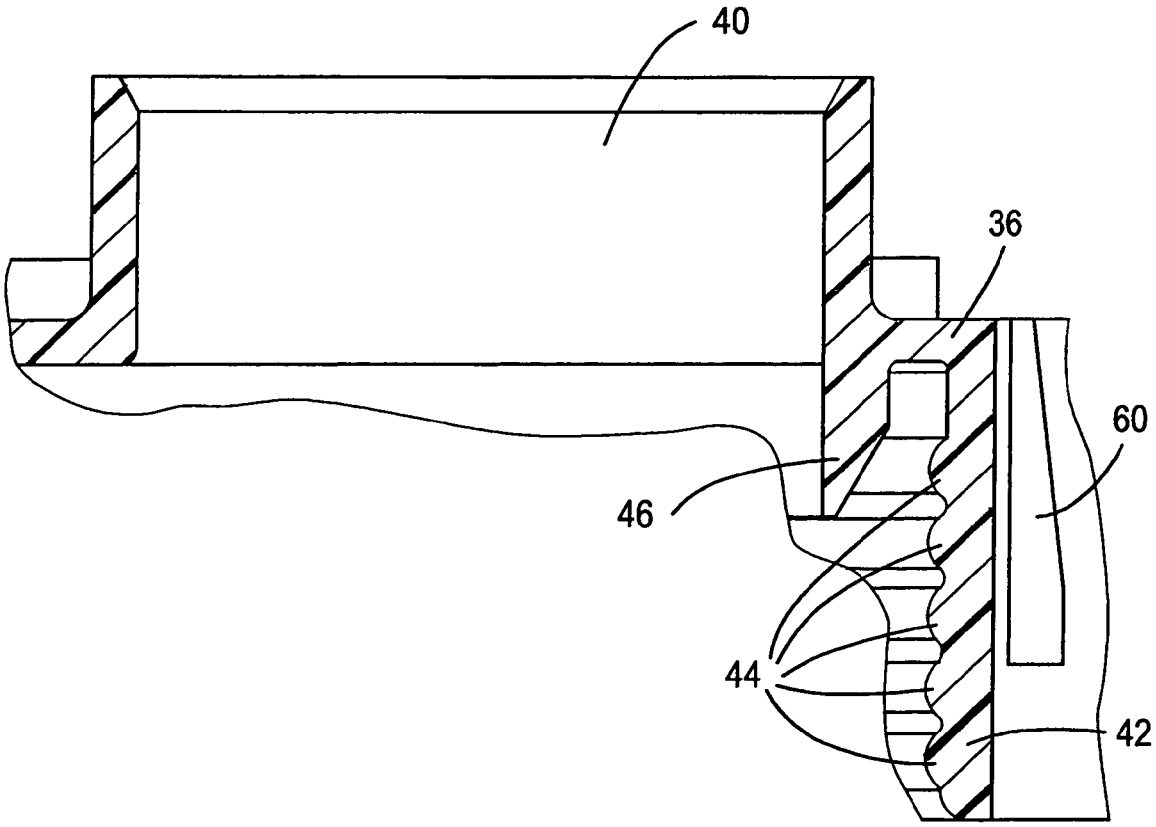
FIG. 12 is a fragmentary sectional view on an enlarged scale of the portion of FIG. 9 within the area 12.

Closure 22 (FIGS. 8-12) includes a deck 36 with a dispensing opening 40 and a wall or skirt 42 extending from deck 36. Wall or skirt 42 is of a non-circular geometry, best seen in FIG. 10, corresponding to the non-circular geometry of neck finish 24 so that wall 42 can be externally received over neck finish 24 as illustrated in FIGS. 1-3. Wall 42 has a plurality of axially spaced circumferentially extending internal engagement elements 44. Elements 44 preferably comprise rounded beads or ribs, best seen in FIGS. 3 and 12, that engage corresponding ratchet teeth engagement elements 30 on neck finish 24. Rounded engagement elements readily ride over the shallow angle of lead-in surfaces 32 on ratchet teeth elements 30, but do not readily move in the opposite direction due to the steep angles on faces 34 of elements 30. Engagement elements 44 could comprise ratchet teeth, but the closure would then be difficult to strip from an injection or compression forming mold. Engagement elements 44 preferably are circumferentially continuous, although gaps or spaces could be provided as previously indicated. A plug seal wall 46 preferably extends from deck 36 within wall 42. In assembly with container neck finish 24, as best seen in FIGS. 1-3, plug seal wall 46 is closely received within the open end of neck finish 24 both to seal the closure to the neck finish, and also to retard or prevent inward compression of neck finish 24 in the event that it is attempted to remove closure 22 from neck finish 24. Plug seal wall 46 thus helps to lock closure 22 on container neck finish 24. At least one external engagement element 30 and at least one internal engagement element 44 preferably are disposed in assembly radially outwardly adjacent to plug seal wall 46 to enhance the locking function of plug seal wall 46. Closure 22 preferably is of one-piece integrally molded plastic construction, such as polypropylene for example.

The exemplary closure 22 illustrated in the drawings preferably is a hinged dispensing closure that includes a base 50 and a lid 52 interconnected by a hinge 54. Hinge 54 can be of any suitable type. The exemplary hinge 54 illustrated in the drawings is of the type disclosed in U.S. Pat. No. 6,041,477. Lid 52 can be pivoted around hinge 54 between a closed position overlying deck 36 and dispensing opening 40, as illustrated in FIGS. 1-4, and an open position illustrated in FIGS. 8-10 for dispensing product. The closure preferably is molded in the open position illustrated in FIGS. 8-12. A child-resistant latch 56 (FIGS. 1 and 3) preferably interconnects lid 52 and base 50 in the closed position of the lid to prevent or retard opening of the lid when the lid is in the closed position. Child-resistant latch 56 preferably is of the type illustrated in U.S. Patent document 2005/0023285A1, the disclosure of which is incorporated herein by reference. Latch 56 preferably includes a latch arm 58 on lid 52 and latch tabs 60 on base 50 that interengage in the closed position of the lid. This particular child-resistant latch arrangement is illustrated by way of example only, and other child-resistant latch arrangements could be employed. In the closed position of the lid over the base, an internal bead 62 (FIG. 4) on lid 52 engages an external bead 64 on base 50 to help hold the lid in the closed position.

There thus have been disclosed a dispensing package in which the closure is non-removably and non-rotatably mounted on the container neck finish, and a closure and a container for such a package, that fully satisfy all of the objects and aims previously set forth. The disclosure has been presented in conjunction with an exemplary embodiment, and additional modifications and variations have been described. Other modifications and variations readily will suggest themselves to persons of ordinary skill in the art. The disclosure is intended to embrace all such modifications and variations as fall within the spirit and broad scope of the appended claims.

The invention claimed is:

1. A dispensing package that includes:

a container having a neck finish with an open end and an axis, a non-circular cross section in a plane perpendicular to said axis, and a plurality of external circumferentially extending engagement elements, and a closure having a wall received over said neck finish, said wall having a non-circular cross section corresponding to said non-circular cross section of said neck finish, and a plurality of axially spaced internal circumferentially extending engagement elements on said wall in engagement with said plurality of axially spaced external circumferentially extending engagement elements on said neck finish to non-removably mount said closure on said container, wherein said closure also has a plug seal wall disposed radially within said closure wall and received within said neck finish, wherein said plug seal wall has a non-circular cross section corresponding to said non-circular cross section of said neck finish, said internal circumferentially extending engagement elements including rounded beads disposed around said closure wall and said external circumferentially extending engagement elements including ratchet teeth on an external surface of the container neck finish and having surfaces facing in the direction of the open end with shallow lead-in angles obtusely disposed with respect to adjacent portions of said external surface of said container neck finish to enable press-fit of said closure onto said container neck finish and surfaces facing away from the open end with steep back angles obtusely disposed with respect to adjacent portions of said external surface of said container neck finish to retard removal of said closure from said neck finish, rotation of said closure on said neck finish being prevented by said non-circular cross sections.

2. The package set forth in claim 1 wherein at least one of said internal engagement elements on said wall and at least one of said external engagement elements on said neck finish being disposed radially outwardly from said plug seal wall.

3. The package set forth in claim 1 wherein said shallow lead-in angles are about 40° to said axis and said steep back angles are about 75° to said axis.

4. The package set forth in claim 1 wherein said engagement elements on said wall and said engagement elements on said neck finish are circumferentially continuous around said wall and said neck finish.

5. The package set forth in claim 1 wherein said closure includes a base on which said wall is disposed, a lid integrally hinged to said base and a child-resistant latch between said lid and said base and disposed radially outwardly of said closure wall.

6. A dispensing package that includes:

a container having a neck finish with an open end and an axis, a non-circular cross section in a plane perpendicular to said axis, and a plurality of axially spaced circumferentially extending external engagement elements, and a closure having a wall received over said neck finish, said wall having a non-circular cross section corresponding to said non-circular cross section of said neck finish, and a plurality of axially spaced circumferentially extending internal engagement elements on said wall in mating engagement with said external engagement elements on said neck finish to non-removably mount said closure on said container, wherein said closure also has a plug seal wall disposed radially within said closure wall and received within said neck finish, wherein said plug seal wall has a non-circular cross section corresponding to said non-circular cross section of said neck finish, said internal engagement elements including rounded beads disposed around said closure wall and said external engagement elements including ratchet teeth on an external surface of the container neck finish and having surfaces facing in the direction of the open end with shallow lead-in angles obtusely disposed with respect to adjacent portions of said external surface of said container neck finish to enable press-fit of said closure onto said neck finish and surfaces facing away from the open end with steep back angles obtusely disposed with respect to adjacent portions of said closure wall to retard removal of said closure from said neck finish, rotation of said closure on said neck finish being prevented by said non-circular cross sections, and said internal engagement elements on said wall and said external engagement elements on said neck finish are circumferentially continuous around said wall and said neck finish.

7. The package set forth in claim 6 wherein at least one of said internal engagement elements on said wall and at least one of said external engagement elements on said neck finish being disposed radially outwardly from said plug-seal wall.

8. The package set forth in claim 6 wherein said closure includes a base on which said wall is disposed, a lid integrally hinged to said base and a child-resistant latch between said lid and said base and disposed radially outwardly of said closure wall.

9. A container having a neck finish to receive a closure, said neck finish having an open end and an axis, a non-circular cross section in a plane perpendicular to said axis to prevent rotation of the closure on said neck finish, and a plurality of axially spaced circumferentially extending engagement elements on said neck finish, said circumferentially extending engagement elements including ratchet teeth on an external surface of the container neck finish and having surfaces facing in the direction of the open end with shallow lead-in angles obtusely disposed with respect to adjacent portions of said external surface of said container neck finish to enable press-fit of a closure onto said neck finish and surfaces facing away from the open end with steep back angles obtusely disposed with respect to adjacent portions of said external surface of said container neck finish to retard removal of the closure from said neck finish for non-removable mounting of the closure to said container.

10. The container set forth in claim 9 wherein said shallow lead-in angles are about 40° to said axis and said steep back angles are about 75° to said axis.

11. The container set forth in claim 9 wherein said external engagement elements are circumferentially continuous around said neck finish.

12. A closure having a wall for receipt over a neck finish on a container to secure the closure to the container, said wall having an axis and a non-circular cross section perpendicular to said axis to prevent rotation of the closure on the container neck finish, a plurality of circumferentially extending axially spaced rounded internal engagement elements on said wall for non-removable mounting of said closure on the container, and a non-circular plug seal wall disposed radially within said closure wall for receipt within the container neck finish, at least one of said engagement elements being disposed radially outwardly from said plug-seal wall such that said at least one of said engagement elements and said plug-seal wall overlap in an axial direction, said internal engagement elements including beads disposed around said wall.

13. The closure set forth in claim 12 wherein said rounded internal engagement elements on said wall are circumferentially continuous around said wall.

14. The closure set forth in claim 12 wherein said closure includes a base on which said wall is disposed, a lid integrally hinged to said base and a child-resistant latch between said lid and said base and disposed radially outwardly of said closure wall.

15. The package set forth in claim 1 wherein said plurality of axially spaced internal circumferentially extending engagement elements include three or more beads.

16. The package set forth in claim 15 wherein said three or more beads include five beads.

17. The package set forth in claim 1 wherein said closure also has a deck from which said wall depends and wherein said deck overlies and contacts an end of said neck finish such that there is no clearance between said neck end and said deck.

18. The package set forth in claim 1 wherein said non-circular cross-sections are oval.

19. The package set forth in claim 1 wherein said closure wall does not have teeth carried thereon to prevent rotation of said closure on said container.

20. The package set forth in claim 6 wherein said plurality of axially spaced internal circumferentially extending engagement elements include three or more beads.

21. The package set forth in claim 20 wherein said three or more beads include five beads.

22. The package set forth in claim 6 wherein said closure also has a deck from which said wall depends and wherein said deck overlies and contacts an end of said neck finish such that there is no clearance between said neck end and said deck.

23. The package set forth in claim 6 wherein said non-circular cross-sections are oval.

24. The package set forth in claim 6 wherein said closure wall does not have teeth carried thereon to prevent rotation of said closure on said container.

25. The container set forth in claim 9 wherein said plurality of axially spaced circumferentially extending engagement elements include three or more engagement elements.

26. The container set forth in claim 25 wherein said three or more engagement elements include five engagement elements.

27. The container set forth in claim 9 wherein said non-circular cross-section is oval.

28. The container set forth in claim 9 wherein said container neck finish does not have serrations carried thereon to prevent rotation of the closure on said container.

29. The closure set forth in claim 12 wherein said plurality of circumferentially extending axially spaced rounded internal engagement elements includes three or more engagement elements.

30. The closure set forth in claim 29 wherein said three or more engagement elements include five engagement elements.

31. The closure set forth in claim 12 wherein said non-circular cross-section is oval.

32. The package set forth in claim 12 wherein said closure wall does not have teeth carried thereon to prevent rotation of said closure on the container.

* * * * *